US010035028B1

(12) United States Patent
Siegel

(10) Patent No.: US 10,035,028 B1
(45) Date of Patent: Jul. 31, 2018

(54) EMERGENCY DESCENDER DEVICE

(71) Applicant: Robert A. Siegel, Waterford, WI (US)

(72) Inventor: Robert A. Siegel, Waterford, WI (US)

(73) Assignee: MALLORY SAFETY+SUPPLY, Longview, WA (US)

( * ) Notice: Subject to any disclaimer, the term of this patent is extended or adjusted under 35 U.S.C. 154(b) by 39 days.

(21) Appl. No.: 15/398,027

(22) Filed: Jan. 4, 2017

(51) Int. Cl.
*A62B 1/10* (2006.01)
*A62B 35/00* (2006.01)
*A62B 1/06* (2006.01)

(52) U.S. Cl.
CPC ..... *A62B 1/10* (2013.01); *A62B 1/06* (2013.01); *A62B 35/0081* (2013.01)

(58) Field of Classification Search
CPC .... A62B 1/00; A62B 1/06; A62B 1/08; A62B 1/10; A62B 1/14; A62B 1/18; A62B 35/005; A62B 35/0081; A62B 29/02; E06C 7/186
See application file for complete search history.

(56) References Cited

U.S. PATENT DOCUMENTS 4,596,314 A * 6/1986 Rogelja ..... A62B 1/14 182/5
5,076,400 A * 12/1991 Petzl ..... A62B 1/14 188/65.5
5,577,576 A * 11/1996 Petzl ..... A62B 1/14 182/193
6,029,777 A * 2/2000 Rogelja ..... A62B 1/14 182/192
6,378,650 B2 * 4/2002 Mauthner ..... A62B 1/10 182/193
7,419,138 B1 * 9/2008 Mauthner ..... B66D 3/08
8,733,504 B2 * 5/2014 Mauthner ..... A62B 1/14 182/191
9,617,128 B2 * 4/2017 Maurice ..... B66D 3/06
9,623,269 B2 * 4/2017 Oddou ..... A62B 1/14
2002/0100900 A1 * 8/2002 Graham ..... B66D 3/10 254/391
2006/0207829 A1 * 9/2006 Mauthner ..... A62B 1/14 182/5
2007/0215411 A1 * 9/2007 Petzl ..... A62B 1/14 182/193
2009/0026023 A1 * 1/2009 Petzl ..... A62B 1/14 188/65.4
2011/0011671 A1 * 1/2011 Chu ..... A62B 1/14 182/5

(Continued)

*Primary Examiner* — Daniel P Cahn
*Assistant Examiner* — Shiref M Mekhaeil
(74) *Attorney, Agent, or Firm* — Donald J. Ersler

(57) ABSTRACT

An emergency descender device preferably includes a base plate, a cover plate, a feed handle, a lock lever, a rope pulley, a release link and at least one spacer. The rope pulley is pivotally retained between the cover and base plates. The feed handle is preferably pivotally retained on the base plate. The lock lever pivots relative to the feed handle. A lock pin is pressed into the lock lever. A portion of the lock pin engages a perimeter of the cover plate to place the emergency descender device in either a lock position or a release position. The rope pulley grips an anchor rope against the at least one spacer in a locked position. One end of the release link is pivotally engaged with the rope pulley and an opposing end of the release link is pivotally engaged with the feed handle.

20 Claims, 5 Drawing Sheets

(56) References Cited

U.S. PATENT DOCUMENTS

| | | | | |
|---|---|---|---|---|
| 2011/0073417 | A1* | 3/2011 | Chaumontet | A62B 1/14 188/65.5 |
| 2012/0241700 | A1* | 9/2012 | Mauthner | A62B 1/14 254/391 |
| 2014/0020983 | A1* | 1/2014 | Casebolt | A62B 1/14 182/241 |
| 2014/0020988 | A1* | 1/2014 | Casebolt | A62B 35/0081 188/65.1 |
| 2014/0138191 | A1* | 5/2014 | Chabod | A62B 1/14 188/65.1 |
| 2014/0196984 | A1* | 7/2014 | Chabod | A62B 1/14 182/18 |
| 2015/0096838 | A1* | 4/2015 | Lefebvre | A63B 29/02 182/191 |
| 2016/0228730 | A1* | 8/2016 | Chaumontet | A62B 1/14 |
| 2016/0287913 | A1* | 10/2016 | Bell | A62B 1/14 |

* cited by examiner

EMERGENCY DESCENDER DEVICE

BACKGROUND OF THE INVENTION

1. Field of the Invention

The present invention relates generally to rescues from elevated structures and more specifically to an emergency descender device, which may be disassembled to repair or replace worn internal parts.

2. Discussion of the Prior Art

It appears that the prior art does not teach or suggest a 540 degree emergency descender device, which may be disassembled to repair or replace worn internal parts. Typically, emergency descender units are salavaged when an internal part becomes worn.

Accordingly, there is a clearly felt need in the art for an emergency descender device, which includes 540 degree rope retention; may be disassembled to repair or replace worn internal parts; and an offset carabineer retention portion.

SUMMARY OF THE INVENTION

The present invention provides an emergency descender device, which may be disassembled to replace worn internal parts. The emergency descender device preferably includes a base plate, a cover plate, a feed handle, a lock lever, a rope pulley, a release link and at least one spacer. The base plate includes a pulley retention portion and a carabineer retention portion, which extends from a bottom of the pulley retention portion. A bottom of the carabineer retention portion is offset inward from the pulley retention portion to contact a bottom of the base plate. A carabineer slot is formed through the carabineer retention portion to retain a carabineer. The cover plate includes a pulley retention portion and a carabineer retention portion, which extends from a bottom of the pulley retention portion. The carabineer retention portion is offset to contact a bottom of the cover plate. A carabineer slot is formed through the carabineer retention portion to retain a carabineer. A junction of the bottoms of the base and cover carabineer retention portions ensure that the carabineer is aligned with an anchor rope. A pulley pivot post is retained between the cover and base plates.

The feed handle is preferably pivotally retained on the base plate. The feed handle includes a base handle portion and a handle lever portion, which extends from an end of the base handle portion at an obtuse angle. A lever slot is cut in the handle lever portion to receive the lock lever. The lock lever includes a base lock portion and a lever portion, which extends outward from the base lock portion at an obtuse angle. A lock pin is pressed through a junction of the base lock portion and the lever portion. A pin slot is formed through the handle lever portion to receive the lock pin. A portion of the lock pin preferably engages a perimeter of the cover plate to place the emergency descender device in either a lock position or a release position.

The rope pulley preferably includes a rope brake portion, a separation plate and a rope anchor portion. A pivot hole is formed a substantially a middle of the rope pulley to receive the pulley pivot post. The rope brake portion extends from one side of the separation plate and the rope anchor portion extends from an opposing side of the separation plate. The rope brake portion preferably includes a substantially oval cross section with three friction bars extending from one end of the oval. Each friction bar includes a curved shape, which extends outward from the oval. The rope anchor surface also includes a substantially oval cross section, with each end having different size radii. A link slot is preferably formed in a front of the rope anchor portion. The release link includes a lengthwise plate, a handle pin and a pulley pin. The handle pin is retained on one end of the lengthwise plate and the handle pin is retained in an opposing end of the lengthwise plate. The pulley pin is pivotally retained in a pivot hole in the rope anchor portion. The handle pin is pivotally retained in a pivot hole in the base handle portion. The at least one spacer is located adjacent a perimeter of the separation plate.

An end of the anchor rope is inserted between the rope brake portion, the at least one spacer and the base plate. The end of the anchor rope is wrapped around the rope brake portion; inserted between the rope brake portion and the at least one spacer; and brought out at a top of the emergency descender device. The end of the anchor rope is then inserted between the lengthwise plate, the base handle portion, the separation plate and the base handle portion. The end of the anchor rope is wrapped around the rope anchor portion and brought out at a top of the emergency descender device. A plurality of retention grooves are formed on a top of the cover plate to receive the lock pin. When the lock pin is positioned in one of the plurality of retention grooves, the user cannot descend. When the lock pin is positioned on a side of the base plate, the user may descend by pulling the feed handle downward the ground.

Accordingly, it is an object of the present invention to provide an emergency descender device, which includes 540 degree rope retention.

It is a further object of the present invention to provide an emergency descender device, which may be disassembled to replace worn internal parts.

Finally, it is another object of the present invention to provide an emergency descender device, which includes an offset carabineer retention loop formed from the base and cover plates.

These and additional objects, advantages, features and benefits of the present invention will become apparent from the following specification.

DETAILED DESCRIPTION OF THE PREFERRED EMBODIMENTS

Figure 2:
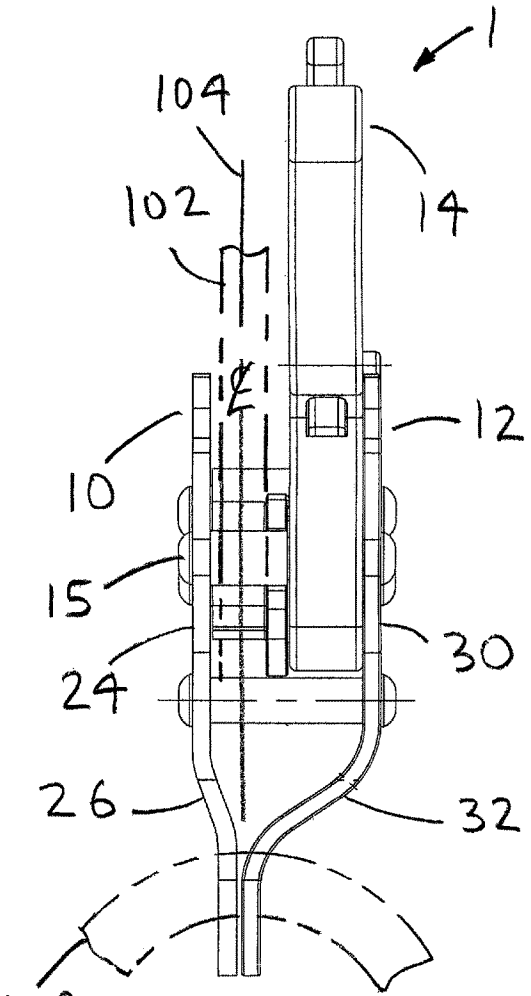
FIG. 2 is an end view of an emergency descender device in accordance with the present invention.
Figure 1:
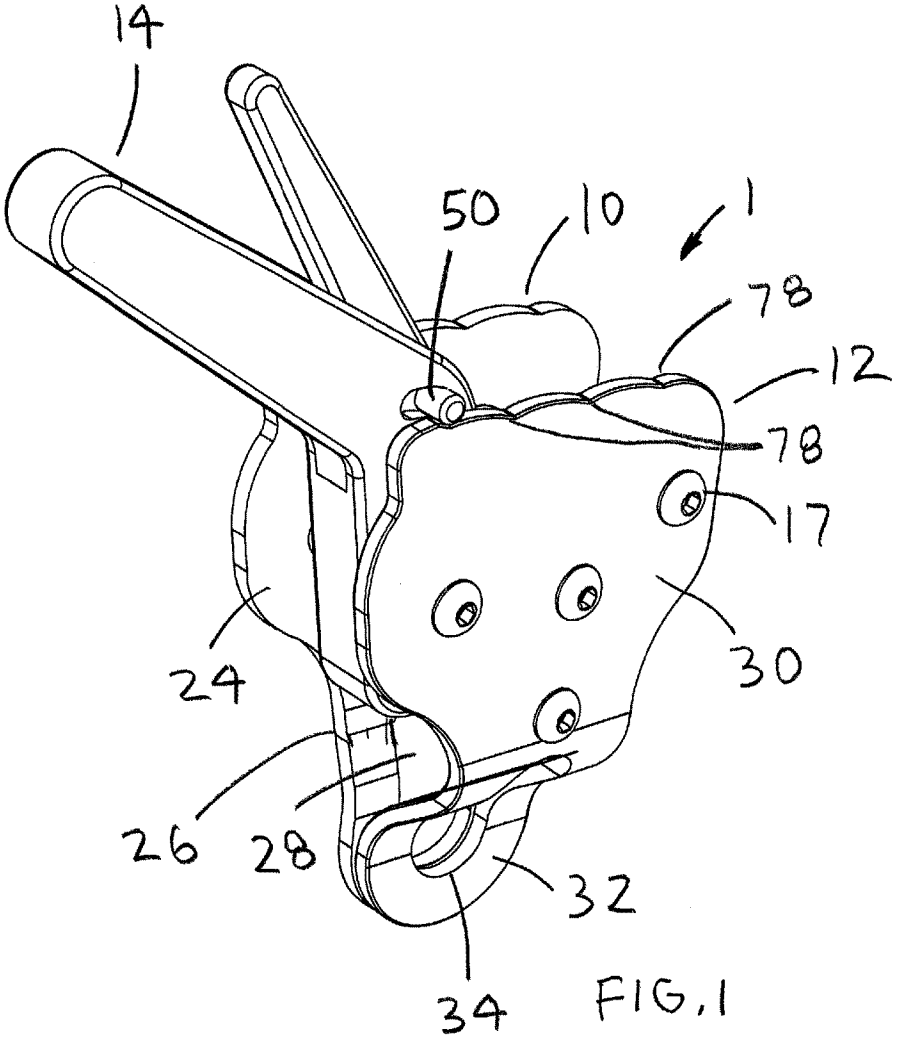
FIG. 1 is a perspective view of an emergency descender device in accordance with the present invention.
Figure 6:
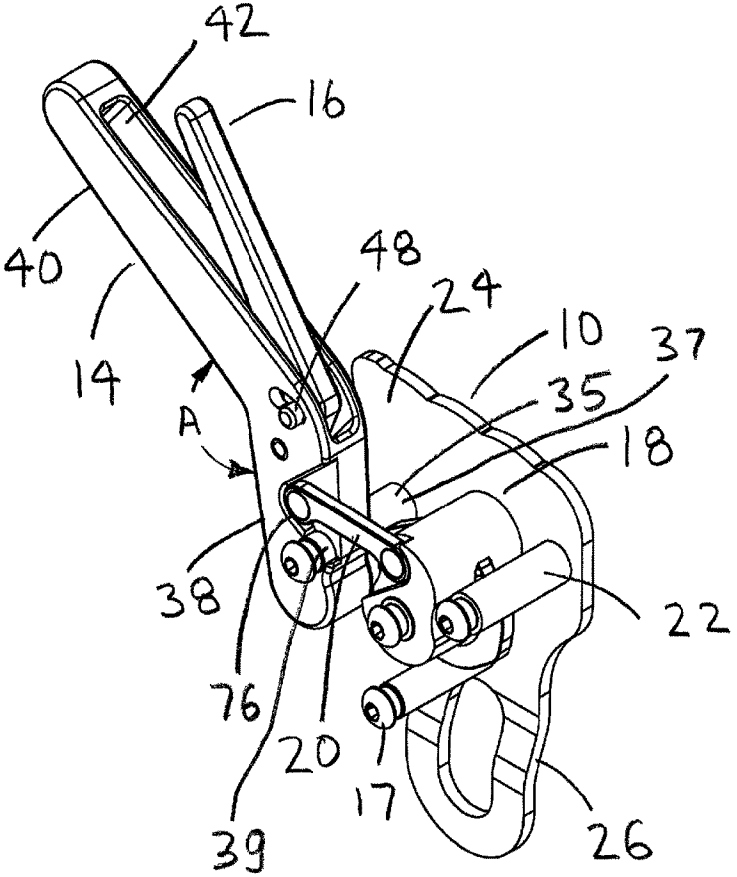
FIG. 6 is a perspective view of an emergency descender device with a cover plate removed in accordance with the present invention.
Figure 3:
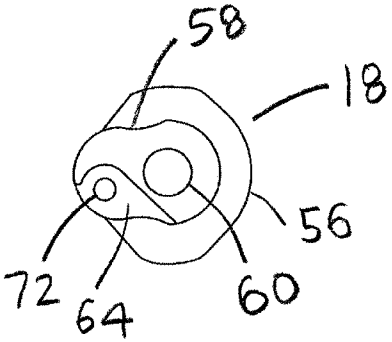
FIG. 3 is a first end view of a rope pulley of an emergency descender device in accordance with the present invention.
Figure 4:
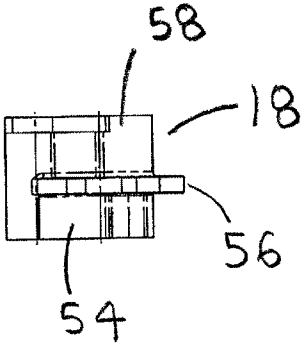
FIG. 4 is a top view of a rope pulley of an emergency descender device in accordance with the present invention.
Figure 5:
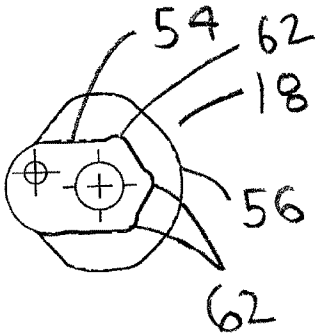
FIG. 5 is a second end view of a rope pulley of an emergency descender device in accordance with the present invention.
Figure 8:
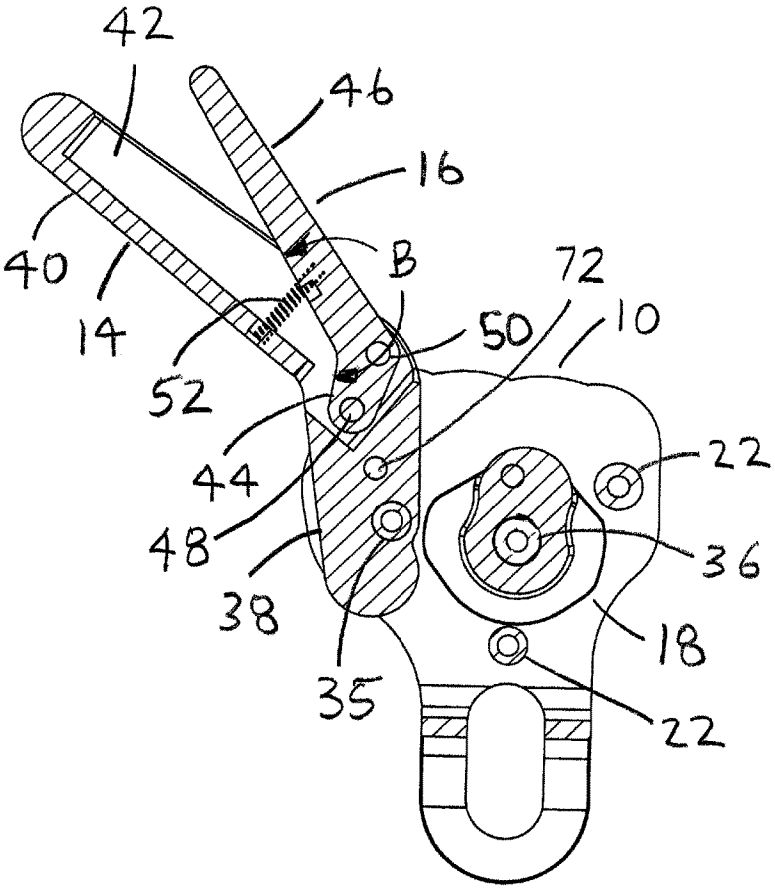
FIG. 8 is a front view of an emergency descender device with a cover plate removed and a cut-away view of a feed handle in accordance with the present invention.
Figure 7:
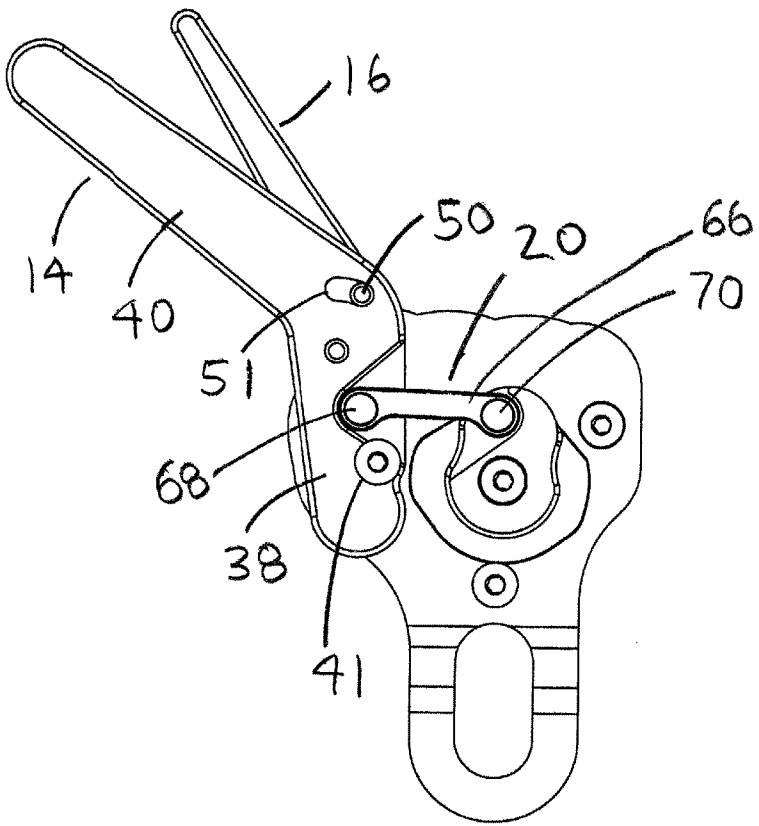
FIG. 7 is a front view of an emergency descender device with a cover plate removed in accordance with the present invention.

With reference now to the drawings, and particularly to FIG. 1, there is shown a perspective view of an emergency descender device 1. With reference to FIGS. 2-6, the emergency descender device 1 preferably includes a base plate 10, a cover plate 12, a feed handle 14, a lock lever 16, a rope pulley 18, a release link 20 and at least one spacer 22. The base plate 10 includes a pulley retention portion 24 and a carabineer retention portion 26, which extends from a bottom of the pulley retention portion 24. A bottom of the carabineer retention portion 26 is offset inward from the pulley retention portion 24 to contact a bottom of the cover plate 12. A carabineer slot 28 is formed through the carabineer retention portion 26 to retain a carabineer 100. The cover plate 12 includes a pulley retention portion 30 and a carabineer retention portion 32, which extends from a bottom of the pulley retention portion 30. The carabineer retention portion 32 is offset to contact a bottom of the carabineer retention portion 26. A carabineer slot 34 is formed through the carabineer retention portion 32 to retain a carabineer 100. A junction of the bottoms of the base and cover carabineer retention portions 26, 32 ensure that the carabineer 100 is aligned with a center line 104 of an anchor rope 102. With reference to FIGS. 7-8, a pulley pivot post 36 is retained between the cover and base plates 10, 12.

The feed handle 14 is preferably pivotally retained on the base plate 10 with a handle pivot post 35. The feed handle 14 includes a base handle portion 38 and a handle lever portion 40, which extends from an end of the base handle portion 38 at an obtuse angle "A." A lock slot 42 is cut in the handle lever portion 40 to receive the lock lever 16. The handle pivot post 35 includes spacer portion 37 and a pivot portion 39, which extends from the spacer portion 37. The pivot portion 39 is sized to receive a handle pivot hole 41 in the base handle portion 38. The lock lever 16 includes a base lock portion 44 and a lever portion 46, which extends outward from the base lock portion 44 at an obtuse angle "B." The base lock portion 44 is pivotally retained in the lock slot 42 with a pivot pin 48. A lock pin 50 is pressed through a junction of the base lock portion 44 and the lever portion 46. A pin slot 51 is formed through the handle lever portion 40 to receive the lock pin 50. A portion of the lock pin 50 preferably engages a perimeter of the cover plate 12 to place the emergency descender device 1 in either a lock position or a release position. An end of the lock lever 16 is preferably biased away from an end of the feed handle 14 with a compression spring 52.

The rope pulley 18 preferably includes a rope brake portion 54, a separation plate 56 and a rope anchor portion 58. The separation plate 56 prevents the anchor rope 102 rubbing against itself. A perimeter of the separation plate 56 is greater than a perimeter of the rope brake portion 54 or the rope anchor portion 58. A pivot hole 60 is formed a substantially a middle of the rope pulley 18 to receive the pulley pivot post 36. A rear of the carabineer retention portion 32 is preferably substantially aligned with a centerline 104 of an anchor rope 102, when the anchor rope 102 is located between the separation plate 56 and the base plate 10. The base plate 10 is preferably attached to one end of the at least one spacer 22, the handle pivot post 35 and the pulley pivot post 36 with a plurality of fasteners 15. The cover plate 12 is attached to the other end of the at least one spacer 22, the handle pivot post 35 and the pulley pivot post 36 with a plurality of threaded fasteners 17.

The rope brake portion 56 extends from one side of the separation plate 56 and the rope anchor portion 58 extends from an opposing side of the separation plate 56. The rope brake portion 54 preferably includes a substantially oval cross section with three friction bars 62 extending from one end of the substantial oval. Each friction bar 62 includes a curved shape, which extends outward from one end of the oval. The rope anchor surface 58 also includes a substantially oval cross section, with each end having different size radii. A link slot 64 is preferably formed in a front of the rope anchor portion 58. The release link 20 includes a lengthwise plate 66, a handle pin 68 and a pulley pin 70. The handle pin 68 is retained on one end of the lengthwise plate 66 and the handle pin 68 is retained in an opposing end of the lengthwise plate 66. The pulley pin 70 is pivotally retained in a pivot hole 72 in the rope anchor portion 58. The handle pin 68 is pivotally retained in a pivot hole 74 in the base handle portion 38. A link slot 76 is preferably formed in the base handle portion 38 to provide clearance for an end of the lengthwise plate 66. The pivot post 35 and the at least one spacer 22 are positioned around a perimeter of the separation plate 56.

Figure 10:
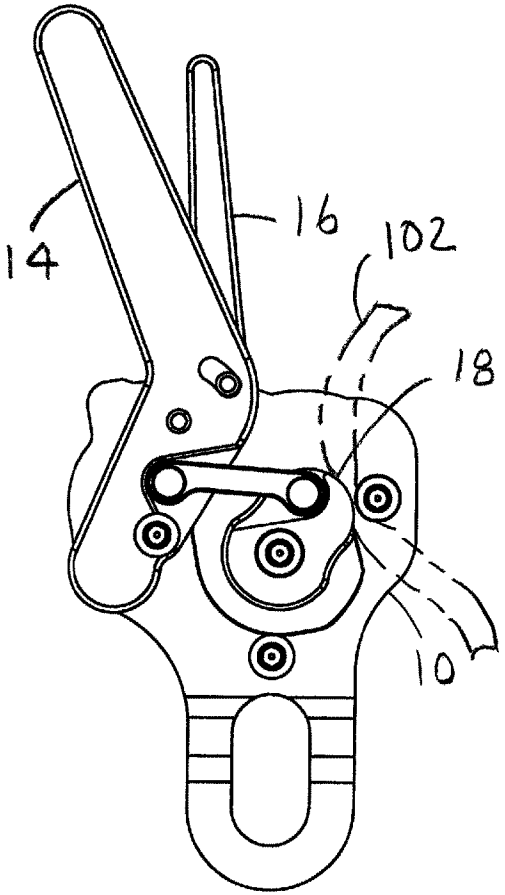
FIG. 10 is a front view of an emergency descender device with a cover plate removed and with a feed handle in a lock position in accordance with the present invention.
Figure 9:
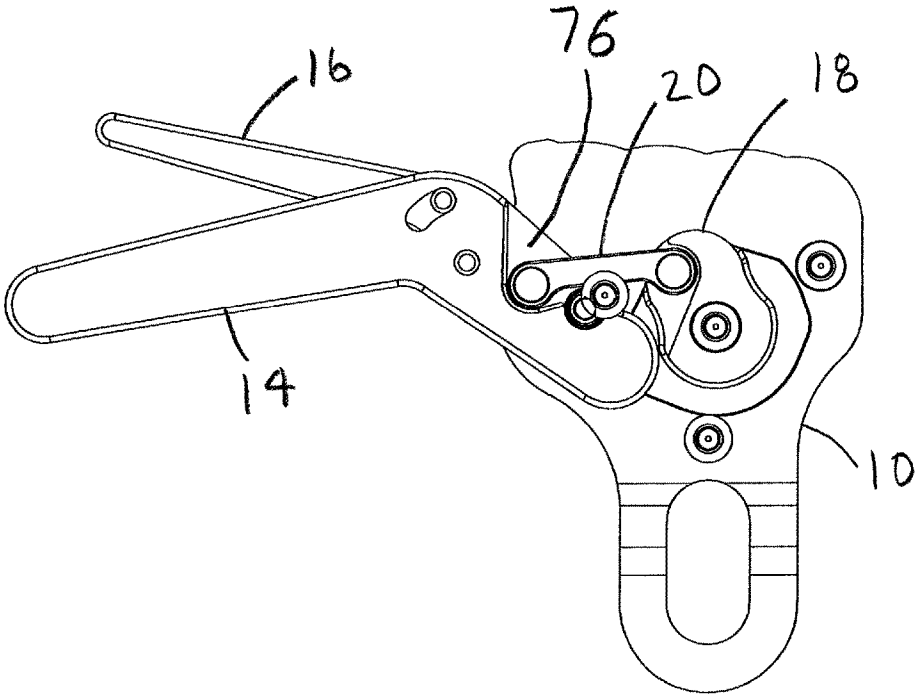
FIG. 9 is a front view of an emergency descender device with a cover plate removed and with a feed handle in a descend position in accordance with the present invention.
Figure 11:
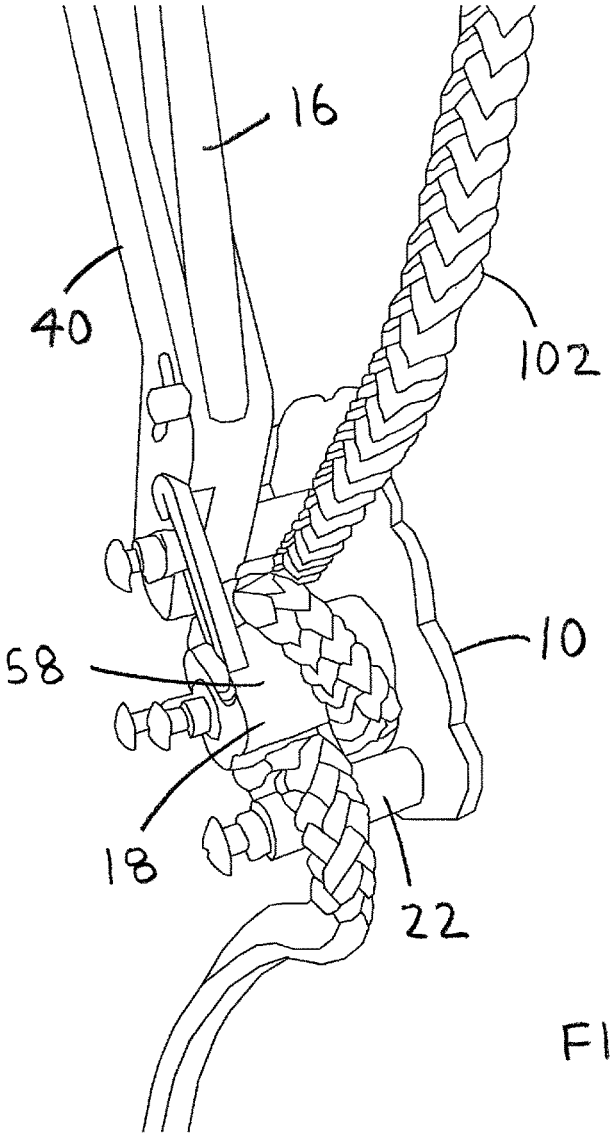
FIG. 11 is a top perspective view of an emergency descender device with a cover plate removed and with an anchor rope retained on a rope pulley in accordance with the present invention.

An end of the anchor rope 102 is inserted between the rope brake portion 54, the pivot post 35 and the base plate 10. The end of the anchor rope 102 is wrapped around the rope brake portion 54; inserted between the at least one spacer 22; and brought out at a top of the emergency descender device 1. The end of the anchor rope 102 is then inserted between the lengthwise plate 66, the base handle portion 38 and the separation plate 56. With reference to FIG. 11, the end of the anchor rope 102 is wrapped around the rope anchor portion 58 of the rope pulley 18 and brought out at a top of the emergency descender device 1. With reference to FIGS. 1 and 9-10, a plurality of retention grooves 78 are formed on a top of the cover plate 12 to receive the lock pin 50. Squeezing the lock lever 16 into the feed handle 14 allows the feed handle 14 to be moved from a top of the cover plate 12 to a side of the cover plate 12. When the lock pin 50 is positioned in one of the plurality of retention grooves 78, the user cannot descend. When the lock pin 50 is positioned on the side of the base plate 12, the user may descend by pulling the feed handle 14 downward toward the ground.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An emergency descender device comprising:

a base plate having a base carabineer slot formed in a bottom thereof;

a cover plate having a cover carabineer slot formed in a bottom thereof;

a feed handle being pivotally retained between said base plate and said cover plate;

a rope pulley being pivotally retained between said base plate and said cover plate;

a release link having one end pivotally engaged with respect to said feed handle, an opposing end of said release link is always pivotally engaged with respect to said rope pulley, wherein pivoting said feed handle causes said rope pulley to pivot; and at least one spacer is retained between said base plate and said cover plate, said at least one spacer is located adjacent said rope pulley;

wherein a major length of said release link is parallel to a major plane of said base plate and a major plane of said cover plate.

2. The emergency descender device of claim 1 wherein:

said rope pulley includes a rope brake portion, a separation plate and a rope anchor portion, said rope brake portion extends from one side of said separation plate, said rope anchor portion extends from an opposing side of said separation plate.

3. The emergency descender device of claim 2 wherein:

a perimeter of said separation plate is greater than a perimeter of said rope brake portion or said rope anchor portion.

4. The emergency descender device of claim 1 wherein:

said cover plate includes a cover pulley retention portion and a cover carabineer retention portion, said cover carabineer retention portion extends from a bottom of said cover pulley retention portion, a portion of said cover carabineer retention portion is offset inward toward said base plate.

5. The emergency descender device of claim 4 wherein:

said base plate includes a base pulley retention portion and a base carabineer retention portion, said base carabineer retention portion extends from a bottom of said base pulley retention portion, a portion of said base carabineer retention portion is offset inward toward said cover plate.

6. The emergency descender device of claim 5 wherein:

a junction of said cover carabineer retention portion and said base carabineer retention portion is substantially aligned with a center line of an anchor rope, when said anchor rope is located between a separation plate of said rope pulley and said base plate.

7. The emergency descender device of claim 4 wherein:

said cover plate is removably attached to said emergency descender device with threaded fasteners.

8. An emergency descender device comprising:

a base plate having a base carabineer slot formed in a bottom thereof;

a cover plate having a cover carabineer slot formed in a bottom thereof;

a feed handle being pivotally retained between said base plate and said cover plate;

a rope pulley being pivotally retained between said base plate and said cover plate;

a release link having one end pivotally engaged with respect to said feed handle, an opposing end of said release link is always pivotally engaged with respect to said rope pulley, wherein pivoting said feed handle causes said rope pulley to pivot; wherein a major length of said release link is parallel to a major plane of said base plate and a major plane of said cover plate; and at least one spacer is retained between said base plate and said cover plate, said at least one spacer is located adjacent said rope pulley, wherein a rope is capable of being retained between said rope pulley and said at least one spacer, said feed handle capable of preventing a feed of the rope through said emergency descender device.

9. The emergency descender device of claim 8 wherein:

said rope pulley includes a rope brake portion, a separation plate and a rope anchor portion, said rope brake portion extends from one side of said separation plate, said rope anchor portion extends from an opposing side of said separation plate.

10. The emergency descender device of claim 9 wherein:

a perimeter of said separation plate is greater than a perimeter of said rope brake portion or said rope anchor portion.

11. The emergency descender device of claim 8 wherein:

said cover plate includes a cover pulley retention portion and a cover carabineer retention portion, said cover carabineer retention portion extends from a bottom of said cover pulley retention portion, a portion of said cover carabineer retention portion is offset inward toward said base plate.

12. The emergency descender device of claim 11 wherein:

said base plate includes a base pulley retention portion and a base carabineer retention portion, said base carabineer retention portion extends from a bottom of said base pulley retention portion, a portion of said base carabineer retention portion is offset inward toward said cover plate.

13. The emergency descender device of claim 12 wherein:

a junction of said cover carabineer retention portion and said base carabineer retention portion is substantially aligned with a center line of said rope, when said rope is located between a separation plate of said rope pulley and said base plate.

14. The emergency descender device of claim 11 wherein:

said cover plate is removably attached to said emergency descender device with threaded fasteners.

15. An emergency descender device comprising:

a base plate having a base carabineer slot formed in a bottom thereof;

a cover plate having a cover carabineer slot formed in a bottom thereof;

a feed handle being pivotally retained between said base plate and said cover plate;

a lock lever is pivotally retained relative to said feed handle, said lock lever includes a pin, said pin directly engages an outer perimeter of at least one of said cover plate and said base plate;

a rope pulley being pivotally retained between said base plate and said cover plate;

a release link having one end pivotally engaged with respect to said feed handle and an opposing end is always pivotally engaged with respect to said rope pulley, wherein pivoting said feed handle causes said rope pulley to pivot; wherein a major length of said release link is parallel to a major plane of said base plate and a major plane of said cover plate; and at least one spacer is retained between said base plate and said cover plate, said at least one spacer is located adjacent said rope pulley.

16. The emergency descender device of claim 15 wherein:

said rope pulley includes a rope brake portion, a separation plate and a rope anchor portion, said rope brake portion extends from one side of said separation plate, said rope anchor portion extends from an opposing side of said separation plate.

17. The emergency descender device of claim 16 wherein:

a perimeter of said separation plate is greater than a perimeter of said rope brake portion or said rope anchor portion.

18. The emergency descender device of claim 15 wherein:

said cover plate includes a cover pulley retention portion and a cover carabineer retention portion, said cover carabineer retention portion extends from a bottom of said cover pulley retention portion, a portion of said cover carabineer retention portion is offset inward toward said base plate.

19. The emergency descender device of claim 18 wherein:

said base plate includes a base pulley retention portion and a base carabineer retention portion, said base carabineer retention portion extends from a bottom of said base pulley retention portion, a portion of said base carabineer retention portion is offset inward toward said cover plate.

20. The emergency descender device of claim 19 wherein:

a junction of said cover carabineer retention portion and said base carabineer retention portion is substantially aligned with a center line of an anchor rope, when said anchor rope is located between a separation plate of said rope pulley and said base plate.

* * * * *